US006109344A

United States Patent [19]

Higgins

[11] Patent Number: 6,109,344

[45] Date of Patent: Aug. 29, 2000

[54] HEAT EXCHANGER WITH AN INTEGRATED TANK AND HEAD SHEET

[75] Inventor: Terry Higgins, Metamora, Mich.

[73] Assignee: Lattimore & Tessmer, Inc., Southfield, Mich.

[21] Appl. No.: 09/080,475

[22] Filed: May 18, 1998

[51] Int. Cl.[7] ..... F28F 9/02

[52] U.S. Cl. ..... 165/174; 165/173; 165/140; 29/890.052

[58] Field of Search ..... 165/140, 174, 165/176, 152, 153; 29/890.052

[56] References Cited

U.S. PATENT DOCUMENTS

| | | | |
|---|---|---|---|
| 3,265,126 | 8/1966 | Donaldson | 165/140 |
| 4,834,171 | 5/1989 | Larrabee et al. | 165/140 |
| 4,923,001 | 5/1990 | Marcolin | 165/140 |
| 4,936,381 | 6/1990 | Alley | 165/176 |
| 4,960,169 | 10/1990 | Granetzke | 165/173 |
| 5,009,262 | 4/1991 | Halstead et al. | 165/140 |
| 5,067,561 | 11/1991 | Joshi et al. | 165/140 |
| 5,151,157 | 9/1992 | Le Gauyer | 165/140 |
| 5,186,245 | 2/1993 | Peters | 165/140 |
| 5,348,083 | 9/1994 | Hosoya et al. | 165/174 |
| 5,398,533 | 3/1995 | Shimanovski et al. | 72/55 |
| 5,582,243 | 12/1996 | Velon | 165/140 |
| 5,737,952 | 4/1998 | Baumann et al. . | |
| 5,782,295 | 7/1998 | Kato et al. | 165/174 |
| 5,794,689 | 8/1998 | Ghiani | 165/140 |
| 5,799,397 | 9/1998 | Yasuda et al. . | |
| 5,898,966 | 5/1999 | Buchanan et al. | 29/890.052 |
| 5,934,366 | 8/1999 | Gowan | 165/174 |

*Primary Examiner*—Ira S. Lazarus
*Assistant Examiner*—Terrell McKinnon
*Attorney, Agent, or Firm*—Harness, Dickey & Pierce, P.L.C.

[57] ABSTRACT

A heat exchanger having a core of a plurality of cooling tubes with a tank at each end of the core tubes. The tanks are formed with a plurality of cooling tube receiving apertures along a side portion of the tanks. These apertures receive the ends of the cooling tubes directly into the tanks and are attached to the tubes by brazing. Since the cooling tubes are received in apertures formed in the tanks themselves, the need for a separate head sheet at the end of the core is eliminated thereby eliminating the need for sealing of a head sheet to a separate tank. The tanks are preferably formed in a hydroforming operation to shape the tanks from a tubular blank.

20 Claims, 2 Drawing Sheets

HEAT EXCHANGER WITH AN INTEGRATED TANK AND HEAD SHEET

BACKGROUND AND SUMMARY OF THE INVENTION

The present invention relates to heat exchangers having a core of cooling tubes with a tank at each end of the core and in particular to a heat exchanger in which the core tubes are directly joined to the tank without an intermediate head sheet.

Typical liquid to air heat exchangers, such as automotive radiators, include a core assembly of a plurality of cooling tubes with fins. The cooling tubes extend between spaced head sheets or header plates. The end of the tubes extend through apertures in the head sheets and are sealed thereto, typically by brazing. A tank formed as a three dimensional stamped metal body or a molded plastic body having an open side, is joined to each of the head sheets and sealed thereto to form a closed tank at each end of the core. Fluid flows from one tank through the cooling tubes to the other tank. A second fluid, typically air, passes between the fins to remove heat from the cooling tubes and thereby cool the fluid in the tubes as it flows from one tank to the other.

The seal between each tank and the head sheet is difficult to properly form and can be the source of leaks during the use of the heat exchanger. Accordingly, it is an object of the invention to provide an improved heat exchanger construction that overcomes the problems associated with the sealing of the core head sheet to the tank.

The present invention overcomes the problems in the prior art by forming the tank and head sheet as an integral, single piece body. A closed tank is formed with apertures along one side for receiving the cooling tubes. The tubes are then inserted directly into the tank. This eliminates the need for a separate head sheet and the need to seal the separate head sheet to the tank. The tubes are sealed to the tank by brazing, in a conventional manner, for constructing a heat exchanger.

The heat exchanger tanks are shaped by a hydroforming process in which an elongated tubular blank is first placed in a die cavity that matches the tank's desired shape. The interior of the tubular blank is sealed and then highly pressurized with a fluid, such as water or oil, so that its outer surface is forced to take the shape of the cavity.

The hydroforming cavity includes inwardly projecting chisel points or punches. After the tube assumes the cavity shape the punches are actuated and pierce the tank.

During hydroforming, outwardly projecting ribs are formed between each of the cooling tube receiving apertures to stiffen the tank. These ribs extend in a circumferential direction relative to the tube longitudinal axis. Cylindrical projections from the tube are also formed during hydroforming. These projections form inlet and outlet necks for the tanks. During hydroforming, the cylindrical projections have closed ends. These ends are later removed, forming the open cylindrically shaped necks.

The open end or ends of the tube blank are closed with an end cap after the tank is hydroformed. The end caps are sealed to the tank by brazing.

An auxiliary oil cooler can be disposed in one of the tanks. The inlet and outlet tubes of the auxiliary cooler extend through one of the tank end caps. The end cap at the opposite end of the tank can be shaped to form a support ledge for supporting the end of the auxiliary cooler.

During hydroforming, outwardly or inwardly extending protrusions can also be formed on the tank to locate the heat exchanger on a rubber mount when attaching the heat exchanger to a supporting structure. The protrusion is typically disposed into a groove in the rubber mount. The rubber mount isolates the heat exchanger from vibration of the support structure, such as an automobile.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
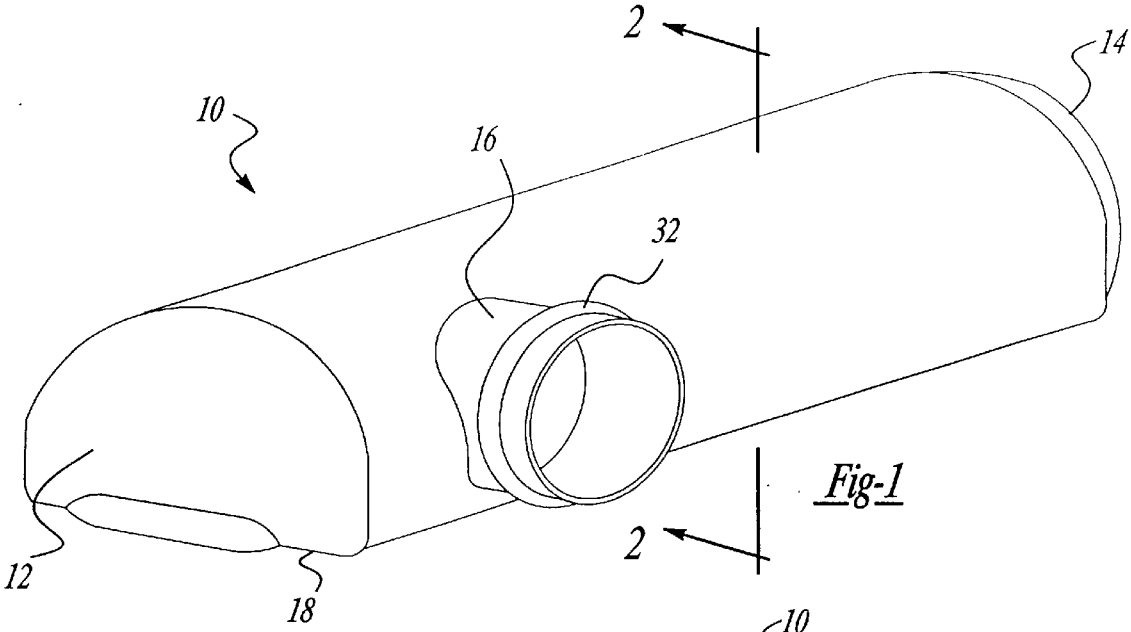
FIG. 1 is a prospective view of a radiator tank constructed according to the present invention.
Figure 2:
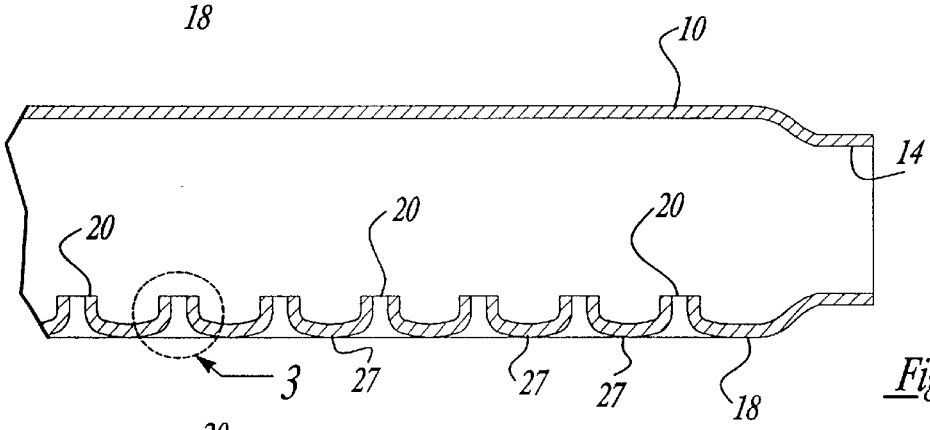
FIG. 2 is a sectional view of the heat exchanger tank as seen from substantially the line 2—2 in FIG. 1.

In reference to FIG. 1, a heat exchanger tank 10 is shown which is made according to the present invention. The tank 10 has a generally tubular body and is shaped by a hydroforming operation. A tubular blank is placed between a pair of dies that close over the tube to create a sealed cavity. The surface of the die cavity matches the desired final shape of the tank 10. The interior of the tubular blank is sealed and highly pressurized with a fluid, such as water or oil, so that its outer surface is forced to take the shape of the cavity. The tank 10 has ends 12 and 14. At least one of the ends is open and possibly both ends are open. The hydroforming liquid is introduced into the tubular blank through an open end. During the hydroforming process, an inlet/outlet 16 is formed which projects or extends from the side of the tank. The tank side portion 18 is generally flat in the preferred embodiment.

Figure 3:
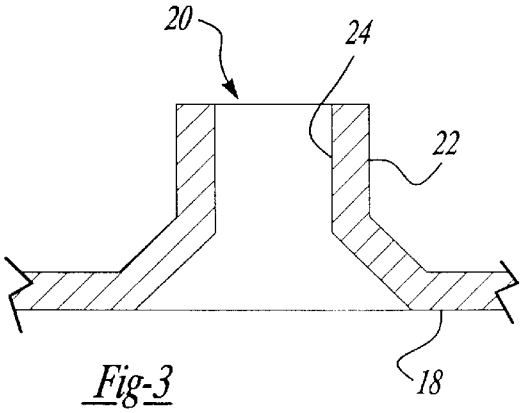
FIG. 3 is an enlarged sectional view of the circled portion of FIG. 2.
Figure 4:
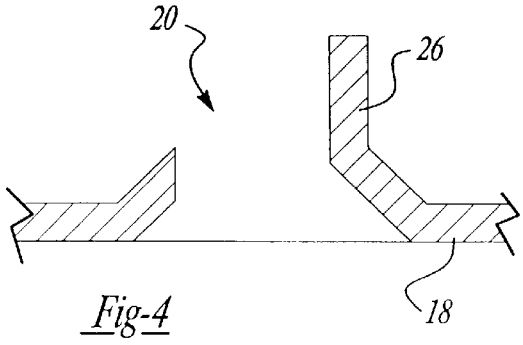
FIG. 4 is an enlarged sectional view of an alternative embodiment of the circled portion in FIG.2

A plurality of chisel points are mounted into the die cavity tool. After the hydroforming operation, the chisel points pierce the tank forming, a plurality of cooling tube apertures 20 in the tank side portion 18. With reference to FIG. 3, a cooling tube aperture 20 is shown in greater detail. As a result of the chisel point pierce operation, the aperture is surrounded by an upstanding ferrule 22. The upstanding ferrule 22 provides a relatively large surface area 24 for contact with a cooling tube that is subsequently inserted into the hole 20. An alternative embodiment of the ferrule is shown in FIG. 4. There a 3-sided punch is used which forms an upstanding slug 26 to one side of the aperture 20.

Between adjacent tube apertures 20, an outward projecting rib 27 is formed. The ribs extend in a circumferential direction transverse to the tube length to stiffen the tank.

Figure 5:
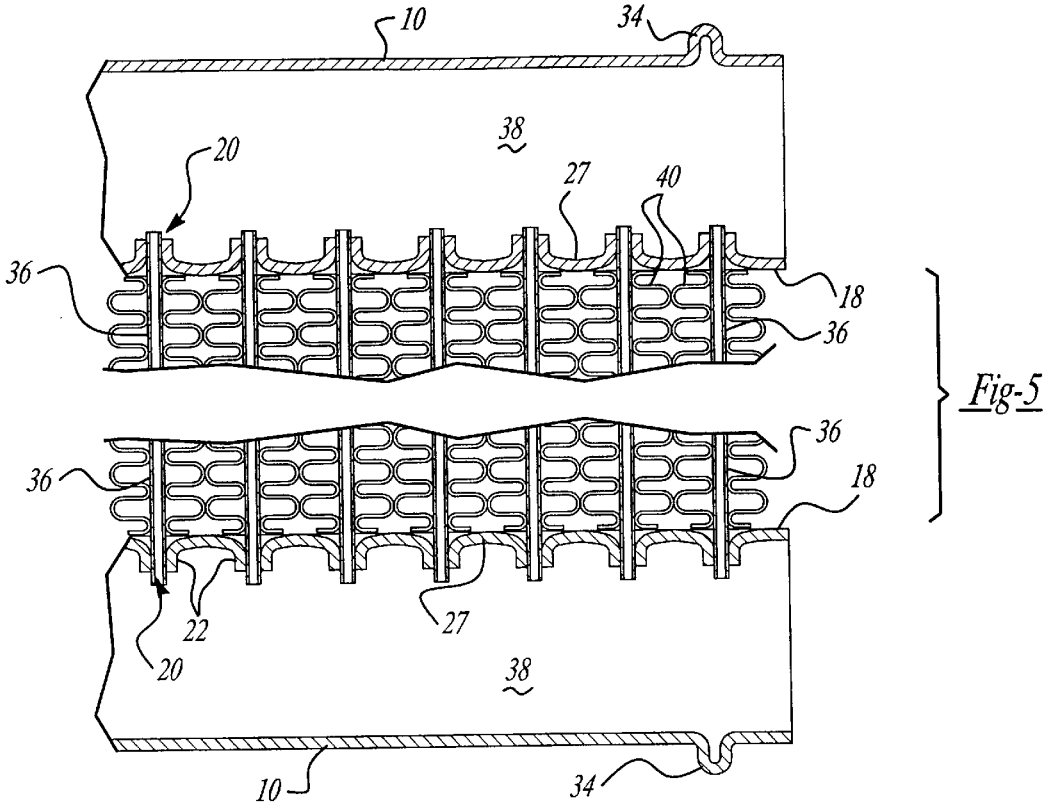
FIG. 5 is a sectional view of a heat exchanger having two tanks and cooling tubes therebetween.
Figure 6:
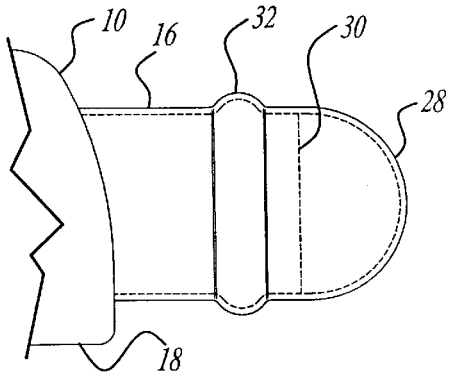
FIG. 6 is a side elevational view of an inlet/outlet to the radiator tank.

With reference to FIG.6, an inlet/outlet 16 is formed during the hydroforming process. The inlet/outlet neck 16 has a closed end portion 28 which may be formed hemispherically as shown in FIG. 6. The closed end portion 28 is removed by cutting the inlet/outlet along the line 30, thereby creating an open end on the inlet/outlet. A raised rib 32 around the neck assists in retaining a hose on the neck. Identically shaped tanks can be used on both ends of the core. On one tank, the neck 16 will be the heat exchanger inlet. On the other tank, it will be the heat exchanger outlet. Both tanks can be made with the same hydroform die. An assembled heat exchanger is shown in greater detail in FIG. 5. A pair of identical tanks 10 are shown spaced from one another. The tanks are oriented with their two flats side positions 18, with the cooling tube apertures, facing each other. The ends of a plurality of cooling tubes 36 are inserted into the cooling tube apertures 20 of each tank. The tubes 36 are typically surrounded by a plurality of flat or corrugated fins 40 to assist in heat transfer from the tubes. The tubes are subsequently brazed to the tanks 10 in a furnace brazing operation in a conventional manner for manufacturing heat exchangers. This provides a sealed connection between the cooling tubes 36 and the tanks 10. The tubes can be at any cross sectional shape but are preferably flat tubes. The tube apertures 20 are correspondingly slot shaped. The slots are oriented parallel to the ribs 27, in a circumferential direction, relative to the tank.

The tanks can be hydroformed with protrusions 34 to locate the tank on a rubber mount, etc., when mounting the heat exchanger on a support structure, such as an automobile body.

The tanks and tubes can be made of aluminum, brass, steel, stainless steel or any of a variety of metals used in heat exchangers or which could be used in heat exchangers.

Figure 7:
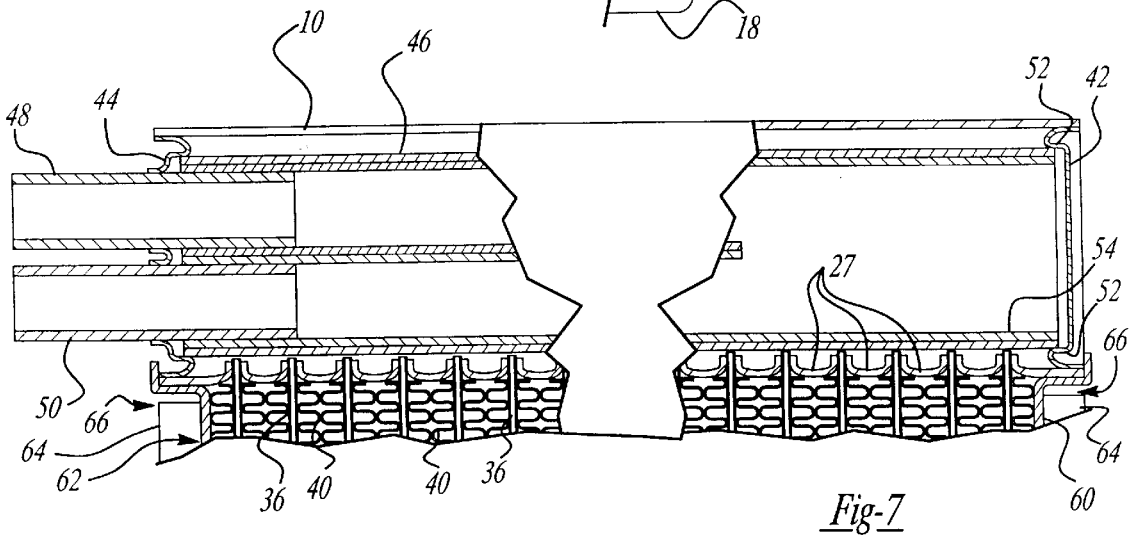
FIG. 7 is sectional view of a tank having an auxiliary oil cooler therein.

With reference to FIG. 7, a tank 10 is shown sealed at the ends by a pair of end caps 42 and 44. The end caps are stamped to shape and are also clad so that they can be brazed to the tank ends. In the embodiment shown in FIG. 7, the tank houses a secondary or auxiliary oil cooler 46 used to cool engine oil or transmission oil in an automotive radiator. The auxiliary cooler has an inlet pipe 48 and an outlet pipe 50 extending through the end cap 44. The end cap 42 is stamped in a shape to form a support ledge 52 to support the distal end 54 of the auxiliary cooler. The end caps are mechanically joined to the tank by toggle locks or other metal crimping operations to hold the end caps in place during assembly and prior to the brazing process.

The heat exchanger may also include a pair of side supports 60 and 62 shown in FIG. 7. These side supports extend between the two tanks 10 and hold the tanks in place relative to one another. These side supports include an outward extending flange 64 to stiffen the side supports. However, at the ends of each side support, there is a small gap 66 in the flange. This forms a stress relief to allow the heat exchanger to expand and contract during thermal cycling.

The heat exchanger of the present invention provides an integrated tank and head sheet. The cooling tube apertures are formed directly into the tanks. This avoids the need for a separate head sheet connected to the cooling tubes which must subsequently be sealed to a tank. In a preferred method of manufacture of the heat exchanger, the tanks are hydroformed to the desired shape and the cooling tube receiving apertures are pierced into the tank after the hydroforming operation. The heat exchanger is subsequently assembled by inserting the cooling tubes directly to the tanks and sealing by brazing, or other joining process.

It is to be understood that the invention is not limited to the exact construction illustrated and described above, but that various changes and modifications may be made without departing from the spirit and scope of the invention as defined in the following claims.

What is claimed is:

1. A heat exchanger comprising:

first and second elongated hollow metal bodies each made by hydroforming of an integral piece above 50 MPA pressure and each having ends, at least one end of each tank being open, the open end being closed by a separate end cap sealingly joined to the hollow bodies whereby the hollow bodies form first and second tanks;

the first tank having a first jointless projection, said first jointless projection forming a fluid inlet; the second tank having a second jointless projection, said second jointless projection forming a fluid outlet;

a side portion of each tank body having a plurality of cooling apertures therein; and a plurality of cooling tubes each having a first end projecting into a tube receiving aperture of the first tank and a second end projecting into a tube receiving aperture of the second tank, the cooling tubes being sealingly joined to the tank in a leak proof manner whereby a fluid can flow into the first tank through the inlet, flow from the first tank through the cooling tubes to the second tank and flow from the second tank through the outlet.

2. The heat exchanger of claim 1 wherein said fluid inlet in the first tank and said fluid outlet from the second tank each comprise a neck projecting from the side of the respective tank and which is integrally formed as a single piece with the first and second tanks, respectively.

3. The heat exchanger of claim 1 further comprising an auxiliary cooler disposed in one of the tanks, the auxiliary cooler having an inlet and an outlet extending through the end cap of tank.

4. The heat exchanger of claim 3 further comprising a second end cap at the other end of the one tank, the second end cap being shaped to form a support for a distal end of the auxiliary cooler opposite from the inlet and outlets of the auxiliary cooler.

5. The heat exchanger of claim 1 further comprising a flange formed by hydroforming and projecting from at least one of the tanks to seat into a groove in a heat exchanger mount.

6. The heat exchanger of claim 1 wherein the cooling tubes are flat tubes and the tube receiving apertures in the tanks are slotted apertures oriented in the tanks to extend in a circumferential direction of the tanks; and further comprising an outward projecting rib between adjacent tube receiving apertures which extends in a circumferential direction around the tanks parallel to the slotted tube receiving apertures.

7. The heat exchanger of claim 1 further comprising a support member extending between the first and second tanks and joined thereto to hold the tanks in position relative to one another, the support member having a small gap to permit the heat exchanger to expand and contract during thermal cycling of the heat exchanger.

8. The heat exchanger of claim 1 wherein the first and second tanks are of identical shape and formed by highly pressurized fluid above 50 MPA to take the shape of the hydroforming cavity.

9. A heat exchanger comprising:

first and second elongated hollow metal bodies each made by hydroforming of a single piece and each having ends, at least one end of each tank being open, the open end being closed by a separate end cap sealingly joined to the hollow bodies whereby the hollow bodies form first and second tanks;

a neck projecting from the first tank and integrally formed therewith as a single piece forming a liquid inlet and a neck projecting from the second tank and integrally formed therewith as a single piece forming a liquid outlet;

a side portion of each tank body having a plurality of cooling apertures; and a core of a plurality of cooling tubes, the tubes each having a first end projecting into a tube receiving aperture of the first tank and a second end projecting into a tube receiving aperture of the second tank, the cooling tubes being sealingly joined to the tank in a leak proof manner whereby a liquid can flow into the first tank through the inlet, flow from the first tank through the cooling tubes to the second tank and flow from the second tank through the outlet, the core further including a plurality of fins joined to and extending from the cooling tubes to facilitate heat transfer from the tubes and a pair of support members extending between and joined to each of the tanks to hold the tanks spaced apart from one another, the support members having means to relieve stress during thermal cycling of the heat exchanger;

the cooling tubes further being flat tubes and the tube receiving apertures in the tanks being slotted apertures oriented in the tanks to extend in a circumferential direction of the tanks; and the tanks having outwardly projecting ribs between adjacent tube receiving apertures which extend in a circumferential direction around the tanks parallel to the slotted tube receiving apertures.

10. The heat exchanger of claim 9 further comprising an auxiliary cooler disposed in one of the tanks, the auxiliary cooler having inlets and outlets extending through the end cap of the tank.

11. A heat exchanger comprising:

first and second elongated hollow metal bodies each made by deformation of an integral piece above 50 MPA pressure and each having open ends, each open end being closed by a separate end cap sealingly joined to the hollow bodies whereby the hollow bodies form first and second tanks;

the first tank having a first integrally formed projection, said first projection forming a fluid inlet; the second tank having a second integrally formed projection, said second projection forming a fluid outlet;

a side portion of each tank body having a plurality of cooling apertures therein; and a plurality of cooling tubes each having a first end projecting into a tube receiving aperture of the first tank and a second end projecting into a tube receiving aperture of the second tank, the cooling tubes being sealingly joined to the tank in a leak proof manner whereby a fluid can flow into the first tank through the inlet, flow from the first tank through the cooling tubes to the second tank and flow from the second tank through the outlet.

12. The heat exchanger of claim 11 wherein said fluid inlet in the first tank and said fluid outlet from the second tank each comprise a neck projecting transversely from the respective tank and which is integrally formed as a single piece with the first and second tanks, respectively.

13. The heat exchanger of claim 11 further comprising an auxiliary cooler disposed in one of the tanks, the auxiliary cooler having an inlet and an outlet extending through the end cap of said tank.

14. The heat exchanger of claim 13 further comprising a second end cap at the other end of the one tank, the second end cap being shaped to form a support for a distal end of the auxiliary cooler opposite from the inlet and outlets of the auxiliary cooler.

15. The heat exchanger of claim 11 further comprising a flange projecting from at least one of the tanks to seat into a groove in a heat exchanger mount.

16. The heat exchanger of claim 11 wherein the cooling tubes are flat tubes and the tube receiving apertures in the tanks are slotted apertures oriented in the tanks to extend in a circumferential direction of the tanks; and further comprising an outward projecting rib between adjacent tube receiving apertures which extends in a circumferential direction around the tanks parallel to the slotted tube receiving apertures.

17. The heat exchanger of claim 11 further comprising a support member extending between the first and second tanks and joined thereto to hold the tanks in position relative to one another, the support member having a small gap to permit the heat exchanger to expand and contract during thermal cycling of the heat exchanger.

18. The heat exchanger of claim 11 wherein the first and second tanks are of identical shape.

19. A heat exchanger comprising:

first and second elongated hollow metal bodies each made of a single integral piece formed by hydroforming and each having a pair of open ends, each of said open ends being closed by a separate end cap sealingly joined to the hollow bodies whereby the hollow bodies form first and second tanks;

a neck projecting from the first tank and integrally formed therewith as a single piece forming a liquid inlet and a neck projecting from the second tank and integrally formed therewith as a single piece forming a liquid outlet;

a side portion of each tank body having a plurality of cooling apertures; and a core of a plurality of cooling tubes, the tubes each having a first end projecting into a tube receiving aperture of the first tank and a second end projecting into a tube receiving aperture of the second tank, the cooling tubes being sealingly joined to the tank in a leak proof manner whereby a liquid can flow into the first tank through the inlet, flow from the first tank through the cooling tubes to the second tank and flow from the second tank through the outlet, the core further including a plurality of fins joined to and extending from the cooling tubes to facilitate heat transfer from the tubes and a pair of support members extending between and joined to each of the tanks to hold the tanks spaced apart from one another, the support members having means to relieve stress during thermal cycling of the heat exchanger;

the cooling tubes further being flat tubes and the tube receiving apertures in the tanks being slotted apertures oriented in the tanks to extend in a circumferential direction of the tanks; and the tanks having outwardly projecting ribs between adjacent tube receiving apertures which extend in a circumferential direction around the tanks parallel to the slotted tube receiving apertures.

20. The heat exchanger of claim 19 further comprising an auxiliary cooler disposed in one of the tanks, the auxiliary cooler having inlets and outlets extending through the end cap of one of said tanks.

* * * * *